United States Patent [19]

Booher, Jr. et al.

[11] 3,966,353

[45] June 29, 1976

[54] CERAMIC-TO-METAL (OR CERAMIC) CUSHION/SEAL FOR USE WITH THREE PIECE CERAMIC STATIONARY VANE ASSEMBLY

[75] Inventors: Claude R. Booher, Jr., West Chester, Pa.; Thomas J. Rahaim, Claymont, Del.

[73] Assignee: Westinghouse Electric Corporation, Pittsburgh, Pa.

[22] Filed: Feb. 21, 1975

[21] Appl. No.: 551,939

[52] U.S. Cl. ..... 415/115; 415/116; 415/214; 415/217

[51] Int. Cl.[2] ..... F01D 9/02

[58] Field of Search ..... 415/214, 115, 116, 217, 415/200; 416/241

[56] References Cited

UNITED STATES PATENTS

| | | | |
|---|---|---|---|
| 2,914,300 | 11/1959 | Sayre | 415/214 |
| 3,601,414 | 8/1971 | Rao | 415/172 A |
| 3,836,282 | 9/1974 | Mandelbaum | 415/217 |
| 3,843,279 | 10/1974 | Crossley et al. | 415/214 |
| 3,857,649 | 12/1974 | Schaller et al. | 415/214 |
| 3,867,065 | 2/1975 | Schaller et al. | 415/214 |

FOREIGN PATENTS OR APPLICATIONS

| | | | |
|---|---|---|---|
| 846,342 | 8/1952 | Germany | 415/214 |
| 836,030 | 6/1960 | United Kingdom | 416/241 B |

*Primary Examiner*—Henry F. Raduazo
*Attorney, Agent, or Firm*—F. J. Baehr, Jr.

[57] ABSTRACT

Cushions made of metal wire provide passageways for cooling air and a resilient layer between metal and ceramic parts in a ceramic blade assembly for a gas turbine.

6 Claims, 3 Drawing Figures

CERAMIC-TO-METAL (OR CERAMIC) CUSHION/SEAL FOR USE WITH THREE PIECE CERAMIC STATIONARY VANE ASSEMBLY

The invention herein described was made in the course of or under a contract or subcontract thereunder with the Department of the Army.

BACKGROUND OF THE INVENTION

This invention relates to gas turbines, and more particularly, to a ceramic blade assembly disposed therein.

High density, high strength, hot pressed, silicon nitride, silicon carbide and other ceramic materials may be utilized in gas turbines to improve the overall efficiency of the turbine by allowing an increase in the turbine inlet temperature to a range of approximately 2500°F. The use of ceramic components necessitates metal-to-ceramic interfaces. Because of surface irregularities, widely different thermal and mechanical properties such as the coefficient of thermal expansion, modulus of elasticity, strength and the high coefficient of friction of the interface between the ceramic and metal parts, the interface is subjected to large edge loading, normal Hertzian and surface tractive-type contact stresses.

SUMMARY OF THE INVENTION

In general, a stationary ceramic vane assembly for an axial flow gas turbine, when made in accordance with this invention, comprises an annular array of stationary ceramic vanes, a plurality of radially inner and radially outer end caps. The end caps have recesses for receiving and locating the vanes. The assembly also comprises metallic shoes which are disposed radially outwardly of the end caps, a cushioning member disposed between the shoes and the end caps, and means for applying a radially inwardly directed force on the shoes to hold the end caps and vanes in position.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENT

Figure 1:
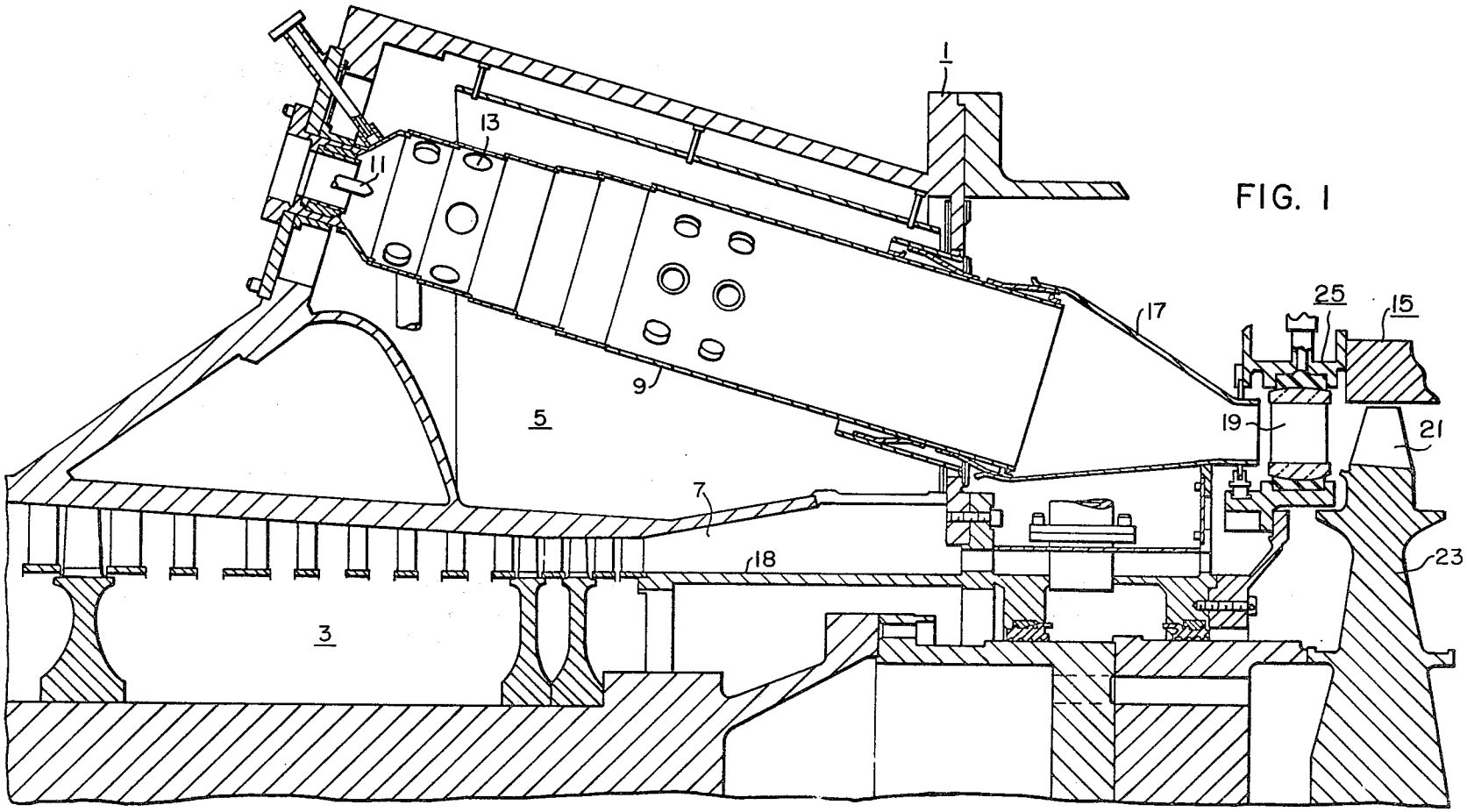
FIG. 1 is a partial sectional view of a gas turbine having a vane assembly made in accordance with this invention.

Referring now to the drawings in detail, FIG. 1 shows a gas turbine 1, which comprises a multistage compressor portion 3, which compresses air; an annular plenum chamber 5 generally surrounding the compressor 3; and a diffuser 7, which directs the compressed air from the compressor to the plenum chamber 5. A plurality of combustion chambers or combustors 9 are disposed in a circular array in the plenum chamber 5 and are provided with fuel nozzles 11 and air inlet openings 13, which cooperate to burn the fuel and produce a hot motive fluid for operating the turbine.

A turbine portion 15 is disposed downstream of the combustors 9 and a transition member 17 directs the hot motive fluid from the combustors 9 to the turbine portion 15. A torque tube 18 connects the turbine portion 15 to the compressor portion 3 and they cooperate with other components to form the gas turbine 1.

Immediately downstream of the transition member 17 is an annular array of stationary vanes or blades 19 and adjacent the stationary vanes 19 is an annular array of rotatable blades 21 disposed on a disc 23.

The stationary vanes 19 direct the motive fluid against the rotatable blades 21 to convert some of the heat and pressure energy in the motive fluid to rotating mechanical energy.

To improve the efficiency of the turbine 1 the motive fluid inlet temperature is raised to a temperature in the range of 2500°F, and to withstand this temperature, the vanes 19 are made of a ceramic material, such as high density, high strength, hot pressed silicon nitride or silicon carbide or other ceramic material.

Figure 2:
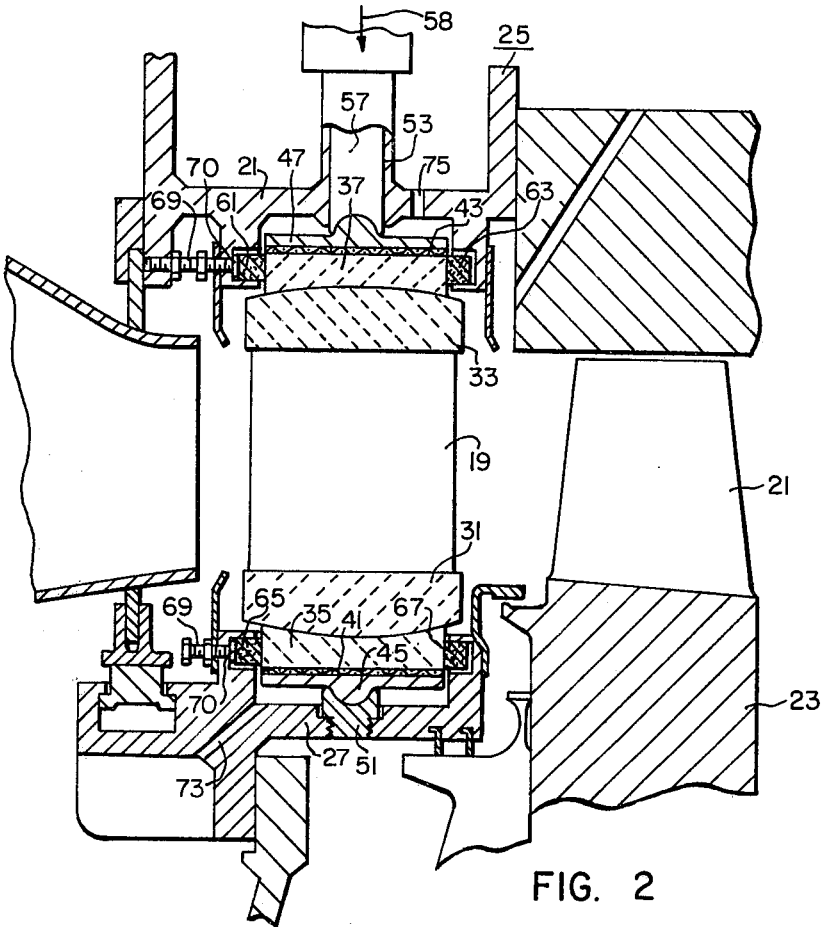
FIG. 2 is an enlarged partial sectional view of the vane assembly.

As shown in FIG. 1, and in more detail in FIG. 2, a special vane assembly 25 is utilized to retain the vanes 19 in their proper disposition within the turbine portion 15.

The vane assembly 25 comprises radially inner and radially outer arcuate support members 27 and 29, respectively, formed from two or more segments having a portion thereof with a U or channel-shaped cross section. The legs of the U or channel are disposed to extend generally radially. The support members 27 and 29 are fastened to a stationary part of the turbine 15 by bolts or other fastening means and form opposing arcuate channels that cooperate to form an annular channel.

Radially inner and outer end caps 31 and 33, respectively, have recesses (not shown) for receiving and locating the vanes 19 and are disposed in engagement therewith. The end caps 31 and 33 are made of ceramic material, as they must withstand high temperatures; however, they are not necessarily made of the same ceramic material as the vanes 19.

Radially inner and outer insulators 35 and 37, respectively, are disposed radially with respect to the end caps 31 and 33 and are cooperatively associated and in engagement therewith so as to prevent major relative movement therebetween.

Radially inner and outer cushioning members 41 and 43, respectively, are radially disposed adjacent the insulator members 35 and 37. The cushioning members 41 and 43 are formed from wire cloth or screen. The screens may be stacked, or they may be woven from single wires or from wire rope. The wire size may vary from .0004 inches to .005 inches. The cushioning members may also be formed from a wire felt consisting of short metal fibers randomly disposed and sintered to produce a metal bond at the point of contact of the fibers.

The density of the cushioning material can be controlled to provide desired thermal and mechanical properties and to set the permeability of the material and thus control the flow of cooling air passing therethrough. While the wire cloth and felt are preferred, perforated sheet and perforated honeycomb products can also be utilized as cushioning members.

Radially inner and radially outer shoes 45 and 47, respectively, are formed from metal and are disposed to engage the inner and outer cushioning members 41 and 43. The support members 27 and 29 have openings 51 and 53 disposed therein and the inner shoe 45 has a boss 55 which registers with and is received by a pin disposed in the opening 51. The radially outer shoe 47 has a rod 57 extending radially therefrom. The rod 57 passes through the opening 53 in the radially outer support 29. A radially inwardly directed force producing means indicated by the arrow 58, such as a spring or other device, biases the outer shoe 47 radially inwardly to position the shoes 45 and 47, the cushioning members 41 and 43, the insulators 35 and 37, the end caps 31 and 33, and the vanes 19 into a workable vane assembly by distributing the applied retention force as well as distributing the forces caused by differential thermal expansion and contraction and allowing the passage of cooling air through the cushioning members to prevent overheating of the shoes.

The arms of the U-shaped portion of the arcuate support members 27 and 29 have arcuate grooves for receiving arcuate shaped upstream and downstream cushioning members 61 and 63 and 65 and 67.

A screw 69 and shoe 70 are disposed to apply an axial force on the upstream cushioning members 61 and 65 to position the insulators 34 and 37, end caps 31 and 33 and vanes 19 axially. The arcuate upstream and downstream cushioning members 61 and 63 and 65 and 67 form a continuous porous ring, thus providing a partial sealing function. Cooling air ports 73 and 75 are disposed in the support members 27 and 29, respectively, and allow cooling air to flow into the channel or U-portion of the support members 27 and 29. The arcuate cushioning members 61, 63, 65 and 67 form partial seals, which control the flow of cooling air and prevent the hot motive fluid from entering this region, thereby preventing the metal components from coming in contact with the high temperature motive fluid.

Figure 3:
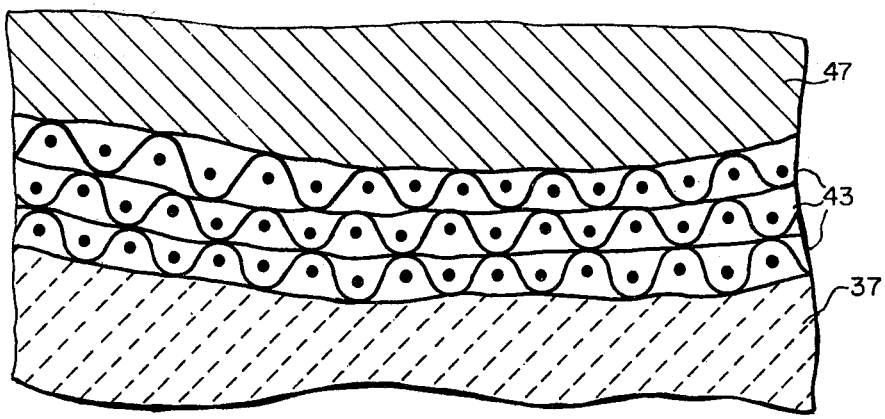
FIG. 3 is an enlarged partial sectional view of a cushioning member interposed between ceramic and metal parts of the assembly.

FIG. 3 shows a ceramic cushion and metal interface with typical surface irregularities. The moments and other forces are so transmitted through the cushion so that the general magnitude of the forces transmitted from one part to the other are equal; however, due to the cooling air passed through the cushion member, the temperature of the metal parts is significantly lower than that of the ceramic parts. The cushioning members also deform to compensate for surface irregularities and to cushion the steady state, dynamic and thermally induced loads applied between the hot ceramic parts and relatively cool metal parts. The cushioning members also establish and maintain clearances and allow the cooling air to cool the metal parts and also operate as a seal to prevent the hot motive fluid from contacting the metal parts, thus assist in producing a workable ceramic vane assembly.

What is claimed is:

1. A ceramic vane assembly for an axial flow gas turbine, said assembly comprising:

an array of stationary ceramic vanes, radially inner and radially outer ceramic end caps, said end caps having recesses for receiving and locating at least one of said vanes, a plurality of radially outer metal shoes disposed radially outwardly of said radially outer end caps, a plurality of radially inner-metal shoes disposed radially inwardly of said radially inner end caps, radially inner and outer cushioning members disposed, respectively, between said inner and outer shoes and said inner and outer end caps, radially inner insulator members disposed between said radially inner end caps and said radially inner cusioning members, radially outer insulator members disposed between said radially outer end caps and said radially outer cushioning members, radially inner and outer generally arcuate support members having a U-shaped portion, the legs of the U being disposed to extend generally radially for receiving the shoes and cushioning members, the inner portions of the legs having arcuate grooves, upstream and downstream axial cushioning members disposed in said grooves, and means for applying a radially inwardly directed force on said shoes to hold said end caps and vanes in position in the assembly.

2. A vane assembly as set forth in claim 1, wherein the axial cushion members are disposed to engage the insulator members.

3. A vane assembly as set forth in claim 1, wherein one of the axial cushions has associated therewith means for biasing the axial cushion axially toward the insulating member.

4. A vane assembly as set forth in claim 1, wherein the axial cusioning member is porous and cooling air passes therethrough.

5. A vane assembly as set forth in claim 1, wherein the axial cushioning members are arcuately shaped segments forming a circumferential ring disposed to prevent axial movement of the vanes and end caps.

6. A vane assembly as set forth in claim 1, wherein the cushioning members are porous and cooling air passes therethrough to cool the metal shoes.

* * * * *